United States Patent [19]

LaBate

[11] Patent Number: 4,573,668

[45] Date of Patent: Mar. 4, 1986

[54] SLAG AND HOT METAL RUNNER SYSTEMS

[76] Inventor: Micheal D. LaBate, 115 Hazen Ave., Ellwood City, Pa. 16117

[21] Appl. No.: 447,408

[22] Filed: Dec. 6, 1982

[51] Int. Cl.[3] ..... C21B 7/14

[52] U.S. Cl. ..... 266/196; 266/231; 266/236; 266/283

[58] Field of Search ..... 266/196, 231, 283, 236

[56] References Cited

U.S. PATENT DOCUMENTS

| | | | |
|---|---|---|---|
| 3,480,125 | 11/1969 | Ash | 266/196 |
| 4,055,336 | 10/1977 | Massin | 266/283 |
| 4,337,930 | 7/1982 | Daussan et al. | 266/283 |
| 4,350,325 | 9/1982 | LaBate | 266/196 |

FOREIGN PATENT DOCUMENTS

| | | | |
|---|---|---|---|
| 2809196 | 9/1979 | Fed. Rep. of Germany | 266/231 |
| 909458 | 10/1962 | United Kingdom | 222/591 |

*Primary Examiner*—M. J. Andrews

*Attorney, Agent, or Firm*—Harpman & Harpman

[57] ABSTRACT

A runner system for receiving and conveying molten slag at the end of an iron pour includes a permanent trough-like construction in which precast side wall panels are removably positioned together with a rammed in place bottom between the side wall panels to form a runner system capable of resisting the increased corrosive properties of slag and having a predetermined life.

8 Claims, 3 Drawing Figures

SLAG AND HOT METAL RUNNER SYSTEMS

BACKGROUND OF THE INVENTION

1. Field of the Invention

This invention relates to an improvement in slag and hot metal runner systems as used in the metal producing industry for delivering molten slag and/or metal from a source to a remote point and providing the runners in the system with removable, replaceable, sidewall panels and rammed bottoms formed in place therebetween.

2. Description of the Prior Art

Runners for handling hot metal are disclosed in U.S. Pat. No. 2,409,741 and such runners generally comprised metal shapes with clay liners as will be understood by those skilled in the art. U.S. Pat. No. 3,365,187 discloses a typical runner system for a blast furnace.

My prior U.S. Pat. Nos. 4,262,885, 4,300,753, 4,328,957, 4,350,325 and 4,355,788 disclose typical improvements in hot metal runners as utilized in the art.

SUMMARY OF THE INVENTION

The present invention relates to a runner system particularly adapted for conveying molten slag as from a blast furnace after an iron pour to a point of discharge. As such, the permanent or semi permanent installation in the pouring floor includes an enlarged trough formed of concrete, refractory brick and hydraulically bonded high alumina refractory concrete defining a trough approximately forty inches wide and forty inches deep in which oppositely disposed sidewall panels, each of which is approximately ten inches thick and thirty inches high are positioned. A separate rammed in place bottom is formed between the sidewall panels so that the resultant composite trough lining is particularly adapted to resist the corrosive properties of slag and thereby attain a substantially improved life as compared with slag runners or hot metal runners heretofore known in the art. The side wall panels and the rammed in place bottom being removable and/or replaced quickly and easily so as to contribute to the low cost maintenance of an effective long life slag and hot metal runner system.

DESCRIPTON OF THE PREFERRED EMBODIMENT

Figure 1:
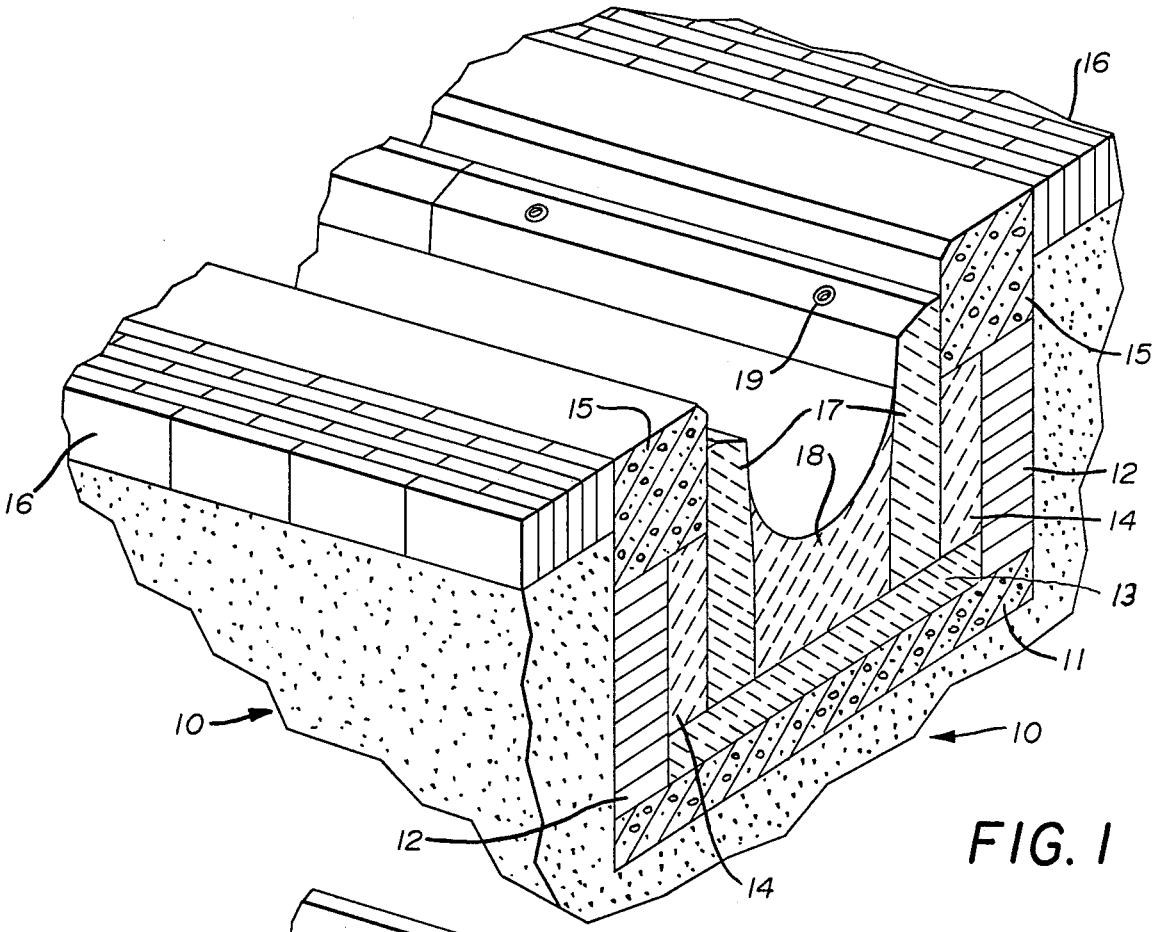
FIG. 1 is a perspective view of a portion of a slag and hot metal runner system with parts broken away and parts in cross section.

By referring to the drawings and FIG. 1 in particular, it will be seen that a runner system for molten slag has been illustrated as being positioned in a pouring floor 10 such as adjacent a blast furnace. The runner system is positioned in a trench formed in the pouring floor 10 and comprises a concrete base slab 11 positioned on the bottom of the trench and a pair of spaced refractory brick sidewalls 12 defining portions of the sides of the trench. A secondary slab 13 of hydraulically bonded high alumina refractory concrete is positioned on the concrete base slab 11 and extends between the refractory brick side walls 2. Precast blocks 14 formed of hydraulic bonded high alumina refractory concrete are positioned along the inner sides of the refractory brick walls 12. Concrete curbs 15 are positioned longitudinally on the upper surfaces of the refractory brick sidewalls 12 and the precast refractory concrete blocks 14, the several elements thus forming the permanent or semi-permanent portions of the slag and/or hot metal runner system positioned in the pouring floor 10.

Additional refractory bricks 16 are preferably positioned along either side of the elongated concrete curbs 15 and form a working surface of the pouring floor 10 as will occur to those skilled in the art.

The slag and/or hot metal runner system is completed by the installation of a plurality of monolithic sidewall panels 17 arranged in oppositely disposed relation against the precast blocks 14 and the concrete curbs 15. A rammed in place monolithic bottom 18 with its upper surface transversely concave is positioned between the sidewall panels 17 to complete the slag and/or hot metal runner system. The sidewall panels 17 are preformed in desirable lengths and are provided at intervals along their upper edges with embedded ceramic inserts 19, each of which defines a threaded passageway for the reception of fasteners to facilitate the handling of the sidewall panels 17 when they are removed and/or replaced as is occasionally necessary due to the erosion by the molten slag and/or hot metal flowing through the runner system. The sidewall panels 17 and the rammed in place bottom 18 are advantageously formed of sinter alumina in a range from 20% to 60%, silicon carbide in a range from 25% to 45% and fire clay or comparable refractory in a range of from 10% to 45% together with a binder such as sodium silicate or phosphoric acid or the like that chemically reacts with the ingredients as will be understood by those skilled in the art.

The sidewall panels 17 and the rammed in place bottom 18 are formed of the same materials except that the binder and water are added to the dry powder on a 50—50 mixture basis so that the powder becomes pliable thus facilitating the ramming of the pliable material which then hardens when dried. The prefabricated sidewall panels 17 are formed of the same materials, but mixed with the binder and water and rammed in molds at the job site, the mixture hardening when dried.

Figure 2:
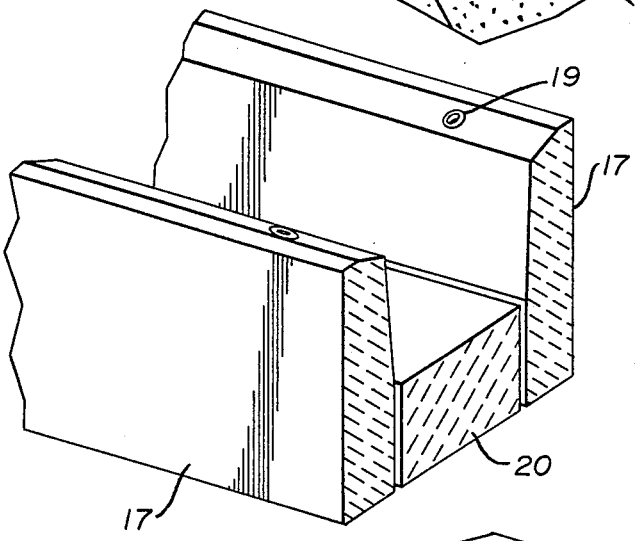
FIG. 2 is a perspective view of a pair of preformed sidewall panels and a rammed in place bottom therebetween with parts in cross section and parts broken away and illustrating the replaceable elements of the slag and hot metal runner system.

It will thus be seen that the sidewall panels 17 and the rammed in place bottom 18 are hereinbefore described comprise modular units as illustrated in FIG. 1 of the drawings and by referring to FIG. 2 of the drawings, these same modular units will be seen with different shaped modular unit bottom 20 replacing the bottom 18 of FIG. 1. The bottom 20, while preferably rammed in place as described in connection with the bottom 18 of FIG. 1 of the drawings, may also be prefabricated in the same manner as the sidewall panels 17 and these removable replaceable sidewall panels 17 and bottoms 18 or 20 thus comprise the expendible portions of the slag and/or hot metal runner systems disclosed herein.

Figure 3:
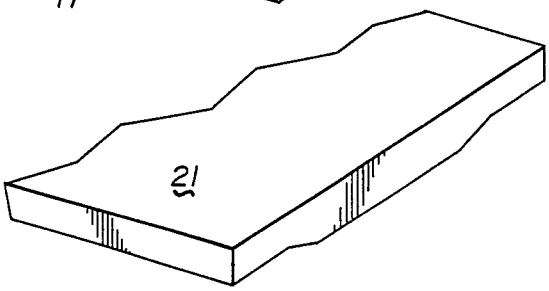
FIG. 3 is a perspective view of a cover which may be used with the slag and hot metal runner system to close the same and limit air pollution.

If desired, covers 21, as seen in FIG. 3, formed of refractory material and preferably provided with transverse ribs over a portion of their lower surfaces can be installed over the upper surfaces of the slag and/or hot metal runner systems to both assist in controlling air pollution and maintaining temperatures at desired levels in the runner systems.

A typical satisfactory mixture of refractory materials from which the sidewall portions 17 and the bottom sections 18 can be successfully formed may comprises sinter alumina powder 20% by weight, silican carbide powder 25% by weight, fire clay or comparable refractory powder or particle 45% by weight and phosphoric acid 10% by weight and water to a desired consistency so that the mixture resulting can be rammed in place in suitable molds in establishing the sidewall panels 17 and the bottom sections 20 and/or the material rammed directly into the trough defining permanent structure to form the rammed in place bottom 18 as hereinbefore described in connection with FIG. 1 of the drawings.

It will occur to those skilled in the art that the permanent or semi-permanent trough defining structure is installed in the pouring floor and becomes a part thereof and that the sidewall panels 17 and bottom sections 18 or 20 as the case may be can be formed on the job site on the pouring floor and installed in the trough defining structure and removed and replaced as necessary, thus considerably improving efficiency on the hot metal pouring floor and avoiding the heretofore laborious and time consuming rechanneling of hot metal and molten slag runners in the pouring floor and/or rearranging and aligning prefabricated blast furnace runners and the like.

The sidewall panels 17 and rammed in place or prefabricated bottoms 18 and 20 as disclosed herein can be coalesced under thermal influence or coalesced under the influence of physical force or both as desired. The composition, density, and size and shape of the sidewall panels 17 and bottom sections 18 and 20 can be varied as desired to achieve a predetermined desired life which can to a great extend eliminate the necessity of visually observing the amount of erosion after each running of molten material through the runner system.

It will occur to those skilled in the art that various changes and modifications may be made in the invention disclosed herein without departing from the spirit thereof or from the scope of the appended claims and having thus described my invention, what I claim is:

1. In a runner system for a hot metal pouring floor, said runner system extending from a source of molten metal and molten slag to a pouring point thereof, said runner system comprising a substantially permanent elongated trough defining structure having fixed side and bottom portions positioned in said pouring floor an improvement in combination therewith comprising: a replaceable means for lining the runner system, said means for lining said runner system consisting of a plurality of monolithic preformed side wall panels extending from the trough bottom portion upwardly for a significant portion of the distance between the trough bottom portion and a top surface of the pouring floor and at least one monolithic bottom section positioned on the trough bottom portion between said side wall panels to be in abutting relationship with said side wall panels whereby said monolithic bottom section extends completely across the trough bottom section between said side wall panels, said side wall panels and bottom section being formed of sinter alumina in a range from 20% to 60%, silicon carbide in a range from 25% to 45%, fire clay in a range from 10% to 35%, a binder selected from a group consisting of sodium silicate and phosphoric acid that reacts with the other materials, and water substantially 10% by weight, said unitary side wall panels being positioned in said trough defining structure against the sides thereof in oppositely disposed relation to one another and said bottom section being positioned in said trough defining structure on the bottom portion thereof and between said side wall panels and in engagement therewith so as to reinforce said elongated trough defining structure and form a replaceable channel for said molten metal and molten slag.

2. The improvement in a runner system set forth in claim 1 and wherein said sidewall panels and said bottom section are formed of a coalesced mass of a mixture consisting of sinter alumina 20% by weight, silicon carbide 25% by weight, fine clay 35% by weight, phosphoric acid 10% by weight and water 10% by weight to mix a desired consistency suitable for shaping.

3. The improvement in a runner system set forth in claim 1 and wherein said sidewall panels and said bottom section are formed of a coalesced mass of a mixture consisting of sinter alumina 20% by weight, silicon carbide 25% by weight, fine clay 35% by weight, and sodium silicate 10% by weight and water substantially 10% by weight to mix a desired consistency suitable for shaping.

4. The improvement in a runner system set forth in claim 1 and wherein said bottom section is rammed in place so as to position it firmly against said unitary preformed side wall panels.

5. The improvement in a runner system set forth in claim 1 and wherein said bottom section is formed of a plurality of monolithic preformed coalesced units.

6. In a runner system for conveying molten slag across a pouring floor from a source of molten slag to a pouring point, the runner system including a trench defined in the pouring floor to have sides and a bottom, an improvement in combination therewith comprising:

a replaceable liner means located in the trench for guiding the molten slag through the trench, said replaceable liner means having:

a plurality of monolithic wall sections, each abutting a corresponding trench side and extending from the trench bottom upwardly for a significant portion of the distance between the trench bottom and the top surface of the pouring floor; and a monolithic bottom section resting on the trench bottom and having side edges which abut corresponding ones of said wall sections whereby said monolithic bottom section extends completely across the trench bottom between said corresponding wall sections;

said wall sections being unattached to each other or to said bottom section or to the corresponding trench side whereby any or all of the elements of said replaceable liner can be easily removed from the trench.

7. The improvement defined in claim 6 wherein said replaceable liner includes a plurality of monolithic bottom sections each having a wall section associated therewith with a wall section associated with one bottom section being nonengaged with a wall section associated with an adjacent bottom section whereby one wall section of adjacent wall sections can be removed from the trench without disturbing the other wall section of such adjacent wall sections.

8. The improvement defined in claim 6 wherein said bottom section extends upwardly from the trench bottom for a substantial portion of the distance between the trench bottom and a top surface of each of said corresponding wall portions.

* * * * *